United States Patent [19]

Pendolino et al.

[11] Patent Number: 4,607,891

[45] Date of Patent: Aug. 26, 1986

[54] ROTARY RETAINER FOR MINING BITS

[75] Inventors: Eugene F. Pendolino; Wayne L. Edmondson, both of Franklin; Michael L. O'Neill, Lucinda, all of Pa.

[73] Assignee: Joy Manufacturing Company, Pittsburgh, Pa.

[21] Appl. No.: 739,945

[22] Filed: May 31, 1985

[51] Int. Cl.[4] ..... E21B 10/00

[52] U.S. Cl. ..... 299/92; 299/91; 299/93

[58] Field of Search ..... 299/91, 92, 93; 37/141 T, 142 A, 142 R; 403/323; 175/410

[56] References Cited

U.S. PATENT DOCUMENTS

| | | | |
|---|---|---|---|
| 1,613,693 | 1/1927 | Davis | 299/91 X |
| 2,720,392 | 10/1955 | Cartlidge | 299/91 |
| 4,094,611 | 6/1978 | Harper et al. | 299/91 X |

*Primary Examiner*—Stephen J. Novosad

*Assistant Examiner*—Thomas J. Odar

*Attorney, Agent, or Firm*—Raymond W. Augustin

[57] ABSTRACT

A cutter bit holding assembly is disclosed. The cutter bit assembly contains a cutter bit having a shank portion and a cutter bit holder having a socket for receiving the cutter bit shank portion. Also included is a rotary locking element which is associated with the cutter bit holder and a bore adjacent the socket. The bore runs in a direction parallel the direction in which the bit holder cuts. The locking element has an offset locking portion which cooperates with an indented locking surface on the bit shank. The rotary locking element is capable of being rotated completely out of the socket bore and out of engagement with the bit shank locking surface to permit the unencumbered removal or insertion of a bit. An elastomeric element inserted along part of the bore in the cutter bit holder is utilized to prevent rotation of the locking element out of engagement with the bit shank locking surface during operation of the cutting device.

9 Claims, 3 Drawing Figures

ROTARY RETAINER FOR MINING BITS

BACKGROUND OF THE INVENTION

1. Field of the Invention

This invention relates to a cutter bit and support therefore and more particularly to an improved resilient detent means which not only holds the bit within a bit holding socket, but provides for easy release of the bit for replacement purposes.

2. Description of the Prior Art

Rotary Detent means for cutter bits are well known in the art and are generally shown in U.S. Pat. Nos. 3,166,052 and 3,057,609. U.S Pat. No. 3,166,052, particularly FIGS. 23–26, discloses a rotary bit holder which is embedded in an elastomeric material. The retaining element is eccentric and can be rotated with a socket wrench into and out of engagement with a recess in the bit shank. The compression of the elastomeric material provides the retaining force against the bit shank.

U.S. Pat. No. 3,057,679 shows an additional detent scheme utilizing elastomeric material and a recess in the bit shank. In this design, the downward force of inserting the bit forces the retaining device against a deformable elastomeric member, thereby permitting insertion of the bit but allowing the retaining device to spring into the socket in the bit shank. A similar device designed by the same inventor is shown in U.S. Pat. Nos. 2,965,365 and 3,088,721.

Patents showing devices extending parallel to the side of the bit shank and engaging indentations therein are shown generally in U.S. Pat. Nos. 1,140,173 and 3,362,754 and 3,751,115. A pin-engagement retaining device for a cutter bit having a shank portion is best shown, however, in South African Patent application No. 65/6900. None of the U.S. patents or the South African applications disclose an offset locking pin held in locking position by a resilient anti-rotational retainer as is taught by applicant.

SUMMARY OF THE INVENTION

It is a primary object of this invention to provide an improved means for retaining the shanks of cutter bits or cutter bit holders in the socket members of chains and cutter heads.

It is yet another object of this invention to provide an improved rotatable detent means for engagement with a bit shank for holding a cutter bit in cutting position in its support.

It is yet an additional object of this invention to provide an offset locking element which includes a yieldable detent means capable of holding the offset portion of the locking element in engagement with the bit shank.

It is still a further object of this invention to provide for a quick release detent device for facilitating replacement of bits in the support sockets of cutting devices.

These and other objects of the present invention may be found in a cutter bit holding assembly which includes a cutter bit having a shank portion and a cutter bit holder having a socket for receiving the cutter bit shank portion. A rotary locking element is associated with the cutter bit holder adjacent the socket thereof for rotation into and out of the socket. The rotating locking means is capable of being positioned for engagement with a locking surface on the bit shank. The rotary locking device is capable of being rotated completed out of the bore and out of engagement with the bit shank locking surface to permit unemcumbered removal or insertion of the bit. An elastomeric material surrounding one portion of the rotary locking device prevents rotation of the locking device during engagement with the bit shank locking surface.

BRIEF DESCRIPTION OF THE DRAWINGS

The above and other objects and features of the invention will become apparent from the following detailed description taking in connection with the accompanying drawings which form a part of the specification, and in which.

DESCRIPTION OF THE PREFERRED EMBODIMENT

Figure 1:
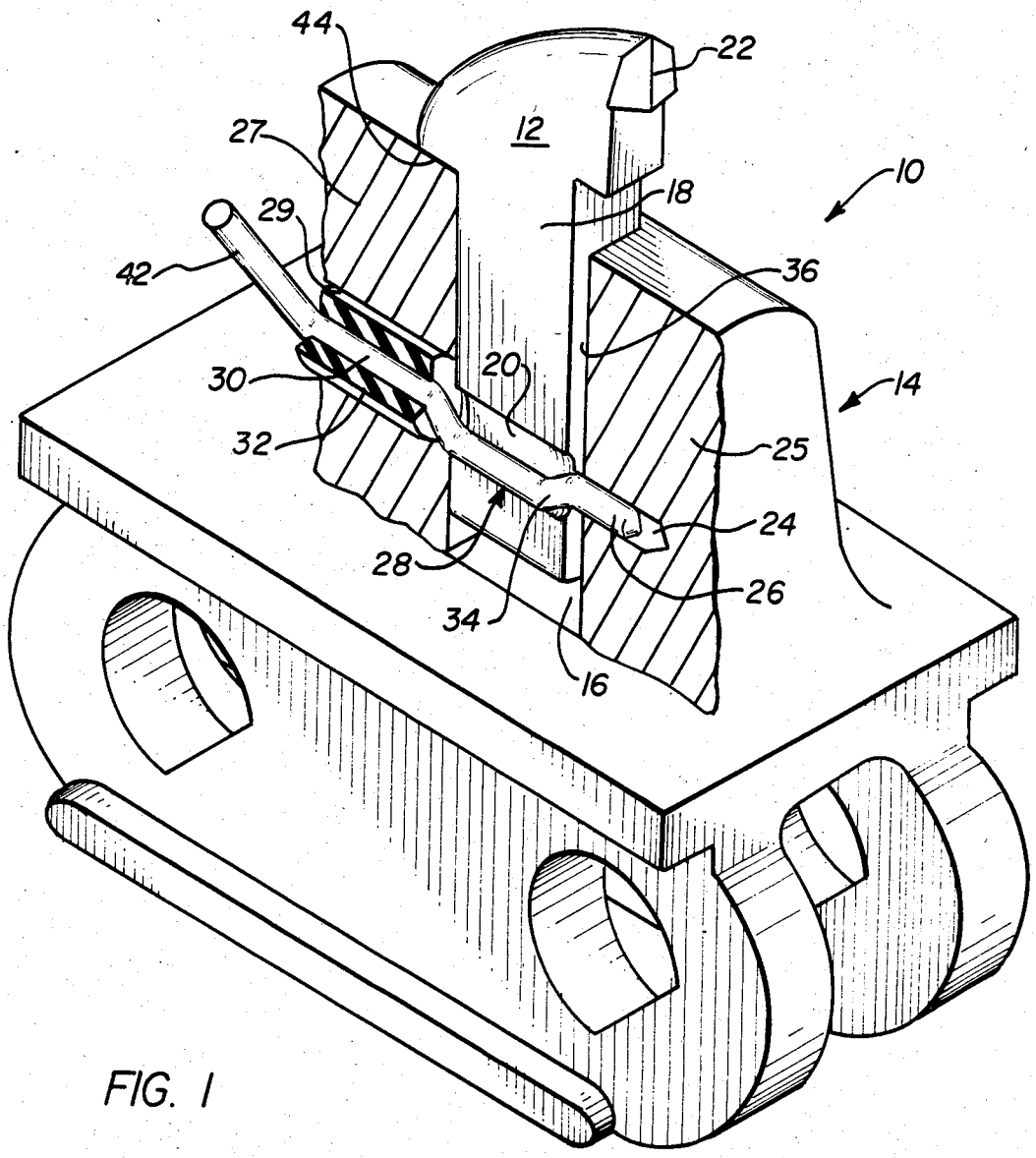
FIG. 1 is a partial isometric view of the rotary retainer of the present invention mounted on a cutter chain element.
Figure 2:
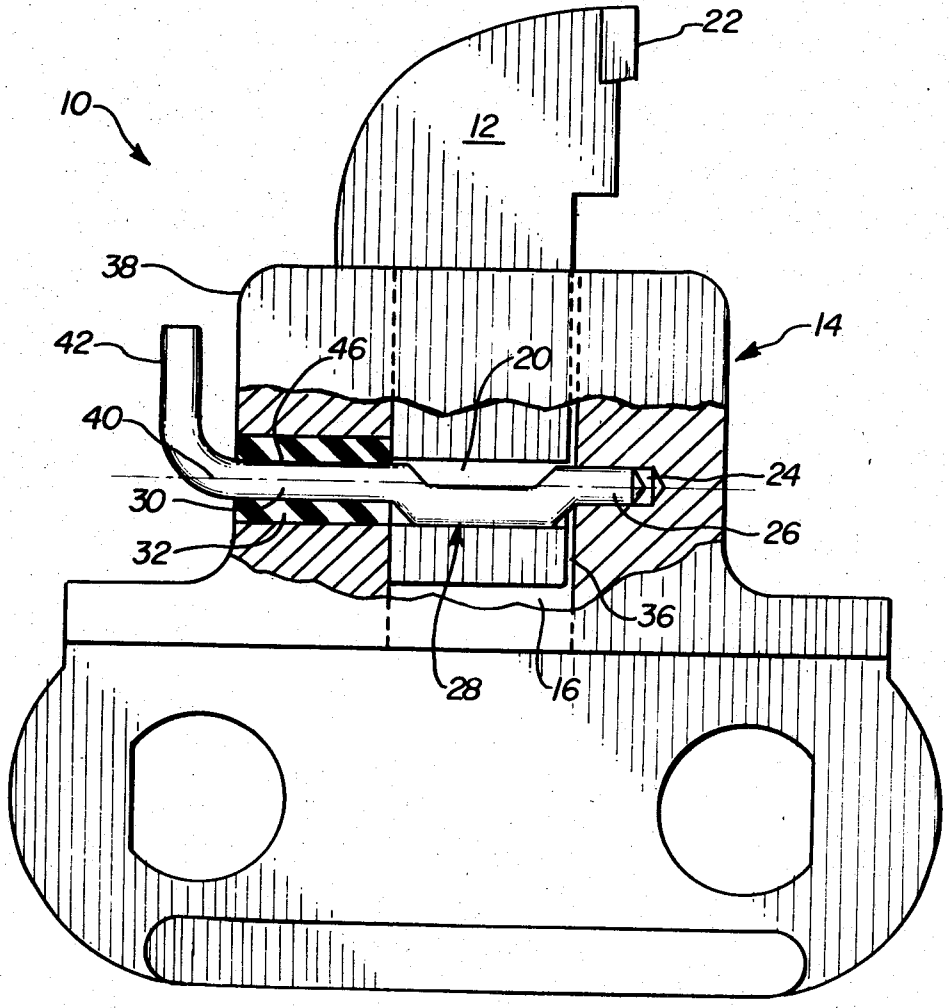
FIG. 2 is a partial sectional side-view of the rotary locking means shown in FIG. 1.

With reference to FIG. 1 and FIG. 2, there is shown a link from a cutter chain which is generally denoted as 10. The cutter chain itself is not shown. It should be noted at the outset that the invention contained herein pertains to a novel way of holding a bit 12 in a bit holder 14. The bit and bit holding system can be mounted on any cutting device such as the drum of a continuous miner or a longwall shearing machine cutting drum or on a cutter chain as shown.

Figure 3:
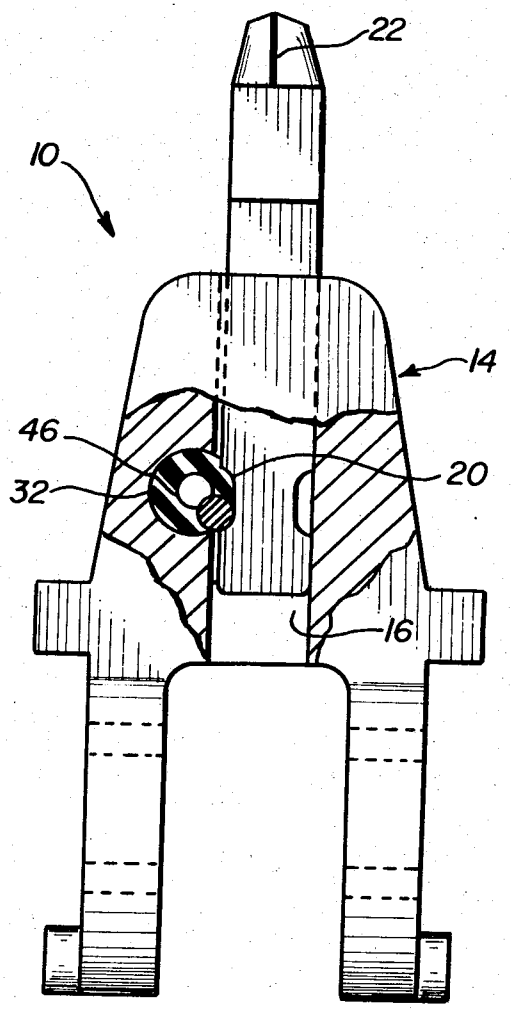
FIG. 3 is a partial sectional view along the lines 3—3 of FIG. 2.

As can be seen in FIGS. 1 through 3, the bit holder has a bore 16 for receiving the shank portion 18 of a bit 12. The shank portion 18 extends a predetermined distance into the bore or socket 16 in the bit holder 14. The shank portion 18 has a indented locking surface 20 running along a side surface which is generally parallel to the direction in which the bit is designed to cut. As can be seen in FIG. 1, the bit cutting tip 22 faces towards the right of FIG. 1 and the indented locking surface 20 runs in a generally left to right direction as shown in FIG. 1.

In the preferred embodiment, the bit holder 14 has a first bore 24 in the portion 25 of the holder 14 which is in advance of the bore or socket 16. The bore 24 is of a diameter capable of rotatably receiving a forward end 26 of an offset locking element generally denoted as 28. The rearward or trailing portion 27 of bit holder 14, that is the portion of the bit holder 14 to the left of the bore 16 in FIG. 1 has a second larger bore capable of receiving the portion 30 of offset locking element 28 which portion 30 is embedded within a cylindrical elastomeric holder 32. The second bore 29 of the trailing portion of bit holder 14 is of a diameter determined by the outer diameter of the elastomeric holder 32. The outer diameter of holder 32 and the inner diameter of bore 29 are sized so that insertion of the holder 32 sufficiently compresses the plug to prevent rotation thereof within the bore 29.

The rotational locking element 28 has an offset portion 34 which, in the preferred embodiment, extends over a substantial length of the engagement surface 20 of bit shank 18 along the longitudinal extent thereof. As can be seen in FIGS. 2 and 3, the bore 29 extends through bit holder 14 from the forward face 36 of bore 16 to the rear surface 38 of bit holder 14.

In the preferred embodiment, the offset portion 34 of locking element 28 is capable of extending at least partially into the bore or socket 16 and into locking engagement with the indented surface 20 on shank 18. The shape and depth of bore 29 is sufficient to allow the offset portion to 34 to be completely rotated out of the bore or socket 16 upon rotation of the locking element 28 to permit removal of bit 12.

In the preferred embodiment, the indented locking surface 20 is of a cross-section where the top and bottom curved surfaces 38 and 40, as can be best seen in FIG. 4, are of the same curviture as the outer diameter of the offset portion 34 of locking element 28. The distance between curve surface 38 and 40 is determined by the arc of rotation of the offset portion 34 of locking element 28. The indented portion 20 is designed so that the offset portion 34 may be rotated either upwardly or downwardly in and out of engagement with the indented locking portion 20.

As can be seen in FIG. 1, the axis of bore 24 and bore 29 are identical, i.e. company axial so that portion 26 and 30 of element 28 rotate about the same axis 40. In the preferred embodiment a handle portion 42 is used to effect rotation.

In the preferred embodiment, the vertical position within the bore 16 of the indented locking portion 20 is determined by the land 44 on bit 12 which engages the top surface 46 of bit holder 14. The vertical position of the portion 20 on shank 18 is such that the indented portion 20 is generally symmetrical about axis 40.

In the preferred embodiment, the elastomeric plug 32 is bonded to portion 30 of element 28 prior to inserting the forward end 26 of element 28 into the pilot bore 24. While in the preferred embodiment the elastomeric plug 32 is bonded to a portion 30 of element 28 but the elastomeric plug can also be molded directly into the portion 30.

In the preferred embodiment the elastomeric plug 32 is also bonded to the inside of bore 29. This insures that the plug 32 does not rotate within bore 29 during movement of the offset locking pin 28. It can be seen that in this configuration, rotational movement of pin 28 will cause a torsional spring force to be developed within plug 32 which force resists rotation of locking element 28. This insures location of the offset portion of element 28 within the indention 20 in the bit. In an alternate embodiment, the holder 32 can be sized larger than bore 29 so that the elastomeric plug into pilot bore 24 and bore 29 causes the plug a 32 to compress and thereby not only keeping itself from rotating within bore 29, but preventing the undesired rotation of element 28. Also as an alternate, the inner diameter of holder 32 can be sized to fit snugly on portion 30 of element 28 prior to this compression. The compression caused by the insertion of holder 32 in bore 29 further develops friction between the elastomeric holder 32 and the portion 30 of locking element 28. The properties of the elastomeric holder 32 and the relative diameters of portion 30 and the inner diameter 46 of holder 32, along with the interference between the outer diameter of holder 32 and inner diameter of bore 29 can be size-produced any desired frictional force on element 28. This sizing can be accomplished to prevent the undesired rotation of element 28 and consequential disengagement from bore 20 of bit 12 during any operating conditions.

The preferred method of operation for removal of a bit 22 is to rotate handle 42 downwardly against the torsional spring force of plug 32, to rotate element 28 about axis 40 until the point where offset portion 34 is totally outside the confines of bore socket 16. At this point, the bit can be removed and a new bit inserted. The handle 42 can then either be rotated upwardly or be automatically rotated upwardly by the torsional spring force developed within plug 32 thereby rotating portion 34 into bore or socket 16 and into engagement with indented locking portion 20 of the new bit 12. The locking element 28 is prevented from rotating out of the portion 20 by the torsional spring force of plug 32 as discussed hereinabove.

It can be seen that other ways of preventing the rotation of element 28 can be utilized to keep offset portion 34 in the locked position. For example, a device can be utilized which would prevent movement of handle 42 or a pin could be inserted through a portion of locking element 28 and into bit holder 14 to prevent rotation thereof any design which would keep offset portion 34 of locking element 28 engaged in groove 20 would satisfy the requirements of applicants invention.

We claim:

1. A cutter bit holding assembly comprising:

a cutter bit having a shank portion;

a cutter bit holder having a socket for receiving said cutter bit shank portion;

a rotary locking means associated with a bore inside cutter bit holder, said bore and at least partially extending within said socket in a direction generally perpendicular to the cutting direction and running the entire length of said socket along an axis generally parallel to the cutting direction of said cutter bit;

said rotary locking means capable of rotating into engagement with a locking surface on said bit shank, said rotary means capable of being rotated completely out of said socket and engagement from said bit shank locking surface into said socket into a portion of said bore not engaging said socket to permit unencumbered removal or insertion of said bit; and selectively engagable means for preventing rotation of said rotary locking means during engagement thereof with said bit shank locking surface.

2. A cutter bit holding assembly as set forth in claim 1 wherein said locking means includes a portion offset from said axis from rotation and said offset portion capable of being rotated completely into or out of said socket and respective engagement and disengagement from said bit shank locking surface to permit said unencumbered removal of said bit.

3. A cutter bit holder assembly as set forth in claim 1 wherein said rotary locking means is a rotatal pin having an offset portion capable of being rotated about said axis into and out of and said bore and into and out of engagement with said bit shank locking surface.

4. A cutter bit holder assembly as set forth in claim 3 wherein said means for preventing rotation of said rotary locking means is an elastomeric holder inserted in said bore and having a central opening therein engaging a portion of said locking pin remote from said offset portion thereof.

5. A cutter bit holding assembly of a mining machine comprising:

a cutter bit having a shank portion;

a support member having a socket for receiving the shank portion of said cutter bit, and a transverse bore relative to the socket extending within said support member partially intersecting the socket thereof define a grooved bore portion immediately adjacent and opening into the socket;

a rotary locking means positioned within the transverse bore of said support member having turning means and an offset portion positioned within the grooved bore portion adjacent the support member socket for rotation from a first position wherein the offset portion is positioned outside of the socket to permit unencumbered insertion or removal of said bit to a second position wherein the offset portion intersects the socket and engages a locking surface from the shank portion of said cutter bit to securely hold said bit within the socket of said support member; and retaining means for preventing rotation of said rotary locking means when positioned in its second position engaging the locking surface of said bit.

6. A cutter bit holding assembly as recited in claim 5 in which the rotary locking means comprises a rod positioned within the transverse bore of said support member said rod having first and second end portions positionable in normally coaxial relationship to respective transverse bore portions on opposite sides of the support member socket, and an intermediate offset portion of said rod being positionable within the grooved bore portion adjacent the socket of said support member, said rod being rotatable from a first position wherein the offset portion is positioned outside of the socket to permit unencumbered insertion or removal of said bit to a second position wherein the offset portion intersects the socket and engages a locking surface on the shank portion of said cutter bit to securely hold said bit within the socket of said support member.

7. A cutter bit holding assembly as recited in claim 6, in which the turning means comprises an extension of said rod extending beyond the exterior surface of said support member to form a handle such that it may be easily grasped to impart a rotary movement to said rod.

8. A cutter bit holding assembly as recited in claim 6 in which the retaining means comprises a resilient bushing member surrounding and bonded to the first end portion of said rod being positionable within the first bore portion of said transverse bore, the resilient bushing member acting to hold said rod in its second position wherein the offset portion engages the locking surface of said cutter bit shank portion due to the wedging action of the offset portion interacting with the locking surface of said shank portion.

9. An improved cutter bit holding assembly of a mining machine of the type in which a support member having a socket therein receives a shank of a cutter bit, wherein the improvement comprises;

a transverse bore relative to the socket partially intersecting the socket to define a first bore portion on one side of the support member, a second bore portion on the opposite side of the support member, and an intermediate groove portion intersecting the socket and opening thereto;

a bit groove cut in the side of the shank such that when the cutter bit is positioned within the socket of the support member the bit groove extends in a substantially parallel direction with respect to the transverse bore, the bit groove opening towards the intermediate groove portion of the support member transverse bore;

a rod coaxially extending into the transverse bore of the support member, the rod having a handle extending exteriorly of the support member for affecting rotation of the rod and an offset portion positionable within the intermediate groove portion of the transverse bore, the rod rotatable from a first position wherein the offset portion thereof is positioned outside the perimeter of the support member socket to permit unencumbered insertion or removal of said bit to a second position wherein the offset portion intersects the support member socket and engages the bit groove of the cutter bit shank to securely hold the cutter bit within the support member socket; and a resilient bushing member surrounding the portion of the rod and being positionable within the first bore portion of the transverse bore to hold the rod in a substantially coaxial position with respect to the first bore portion, the resilient bushing member acting to constantly urge the offset rod portion securely within the cutter bit groove when positioned in its second position to prevent the accidental removal of the cutter bit from the support member socket.

* * * * *